US005321873A

United States Patent [19]

Goria

[11] Patent Number: 5,321,873

[45] Date of Patent: * Jun. 21, 1994

[54] BURIAL CONTAINER

[76] Inventor: Pierre A. Goria, P.O. Box 39, McLeansville, N.C. 27301

[ * ] Notice: The portion of the term of this patent subsequent to Sep. 21, 2010 has been disclaimed.

[21] Appl. No.: 59,062

[22] Filed: May 10, 1993

Related U.S. Application Data

[63] Continuation-in-part of Ser. No. 843,594, Feb. 28, 1992, Pat. No. 5,245,733.

[51] Int. Cl.[5] ..... A61G 17/00

[52] U.S. Cl. ..... 27/35; 27/3; 264/256

[58] Field of Search ..... 27/2, 6, 7, 4, 35, 19; 264/256

[56] References Cited

U.S. PATENT DOCUMENTS

| | | | |
|---|---|---|---|
| 2,655,714 | 10/1953 | Rench | 27/35 |
| 2,940,156 | 6/1960 | Cook | 27/35 |
| 3,038,232 | 6/1962 | Wean | 27/35 |
| 4,261,083 | 4/1981 | Darby et al. | 27/35 |

*Primary Examiner*—Carl D. Friedman
*Assistant Examiner*—Kien Nguyen

[57] ABSTRACT

A burial container having a seamless single piece base with a bottom, sides and ends, each of which has an inner wall and an outer wall and a seamless single piece lid having an inner and outer wall, the lid sealably securable to the base. The lid, bottom side and end inner and outer walls form hollow chambers capable of being filled with cellular concrete or other structural flowable materials. The inner and outer walls of the lid and base may be parallel and unconnected or connected at a plurality of locations to hold the walls in a substantially fixed relationship with each other and thereby strengthen the lid, bottom, sides and ends to withstand the forces exerted by the surrounding earth and water.

10 Claims, 6 Drawing Sheets

BURIAL CONTAINER

This application is a continuation-in-part application of U.S. patent application Ser. No. 07/843,594 filed Feb. 28, 1992 now U.S. Pat. No. 5,245,733.

BACKGROUND OF THE INVENTION

1. Field of the Invention

The present invention relates generally to burial containers for the interment of human or animal remains and is particularly concerned with a burial container, the lid and base of which are formed in a sexless and single piece and have walls spaced and/or braced from each other.

2. Description of the Prior Art

Caskets in common use at the present time are usually bulky structures made of wood or metal and fitted with elaborate ornamentation. For the most part, such burial caskets are not completely sealable or cannot withstand the soil loads of interment. Consequently, they are usually placed in a massive burial vault made of concrete or some other similar material.

Concrete burial vaults are porous and therefore under soil load pressure will eventually permit the flow of moisture into the vault interior. Attempts have been made to line such vaults with plastic or fiberglass shells, however the continuous pressure of the soil load eventually will cause moisture to move through the pores of the concrete and separate the interior shell from the concrete to which it was originally adhered. An example of the plastic lined version of such a vault is shown in U.S. Pat. No. 3,439,461.

Other coatings have been applied to the concrete walls of vaults in an attempt to completely seal them from moisture. In none of these earlier developments has one hundred percent (100%) efficiency in preventing moisture seepage and wall separation been achieved. Other variations in vault construction include forming a double wall of reinforced concrete having an inner asphalt liner between the two (2) concrete walls. Other vaults have been made of various molded plastic resinous materials, concrete outer walls having an inner liner of glass, fiber-reinforced resin, and combinations of other pressure and moisture-resisting substances.

All such prior vaults have had certain desirable advantages and in some instances, certain undesirable features and disadvantages. For example, burial vaults made entirely of reinforced concrete where properly made and of a proper wall thickness, have adequate structural and tensile strength to resist the crushing force of the overlying earth load as well as the additional pressure of earth-handling machinery moved thereover, commonly occurring in cemetery operations. However, such vaults made of reinforced concrete are heavy and tend to allow moisture to infiltrate through the porous concrete wall of the vault due to the hydrostatic pressure in the grave opening.

Prior burial vaults made entirely of synthetic plastic resinous materials have been known and used heretofore and certain of them have desirable advantages and characteristics. Yet a distinct disadvantage is the lack of adequate structural, tensile and flexural strength and the resulting inability to withstand the crushing weight of the overlying earth load and the hydrostatic pressure when the vault is interred in the grave opening, and the additional weight when earth-handling machinery is moved thereover.

SUMMARY AND OBJECTIVES OF THE INVENTION

The present invention is formed from two (2) seamless hollow components, a base and a lid, formed by applying new technology that results in a burial container completely impervious to moisture and strengthened by filling its hollow interior with cellular concrete or other structural flowable materials, A plurality of pins or connectors may be applied to connect the plural walls of the container but which will become a part of thee seamless structure after the molding process has been completed. The hollow walls are filled with a non-adhering substance that will permit the walls to flex under load and yet not fail. Thus is produced a corrosion-proof burial container having a structural and tensile strength sufficient to resist earth and earth-moving machinery loads heretofore not known.

The unit is formed of concentric walls of synthetic resinous material of specified flexural modulus, either unconnected or connected by spacing and bracing means which act in compression or in tension rather than mere resistance to flexing as in the case of references such a U.S. Pat. Nos. 2,655,714 and 3,038,232. These references depend on the structural steel bracing made of angle and channel iron that is welded in place to keep the walls from flexing. Since they are made of steel, they can ultimately fail as a result of corrosion. The failure can be in the form of collapse or water penetration. The present invention does not depend on the connection of the pins to hold the wall in place or to hold the walls apart. The purpose of the wall connection is to hold the inside wall from collapsing only if there is a failure or water penetrating the outer wall. Thus the pins in the present invention are not a structural element themselves but become a factor once the cellular concrete or other structural flowable materials are placed around them.

Rigid concrete burial vaults are subject to cracking with earth pressures and movement, especially if the ground is uneven and the hardness of the ground underneath the vault varies. This will cause cracks in the vault due to stress, which result in leaks and eventual collapse. Applicant's invention is designed so that there is a certain amount of flexing ability between the walls (and around the pins when they are used) that allow for movement without causing damage that would result in failure. This is achieved by allowing the outer skin to move since it is not attached to the cellular concrete or other structural flowable materials that might be used.

In those burial containers that are sufficiently thick and formidable in construction to withstand pressure and moisture, the fabrication process is done by conventionally joining various components to form a fabricated unit intricate in design and complicated in structure. Moreover, when such devices are filled with rigid concrete that adheres to the structure of the container, the concrete is subject to cracking and because it adheres to the liner, eventually causes liner failure resulting in leakage or collapse.

The present burial container is a completely seamless double-walled unit formed of a single piece base having a bottom, sides and ends, each with an inner and outer wall, and a single piece lid having an inner and outer wall, the lid being sealably securable to the base. The hollow base and lid are filled with a flowable concrete or other structural flowable material through an opening of small diameter, for example, a one-half (½") diameter hole, which can be fused to return the part to a sealed and seamless condition after filling. The inner and outer walls of the base and lid may or may not be connected at a plurality locations with spacers that hold the walls in a substantially fixed relationship with each other and become a part of the seamless unit during the molding process, thereby strengthening the lid, bottom, sides and ends to withstand the forces exerted by the surrounding earth and water.

According, an object of the present invention is to provide a new and improved composite hollow wall burial container having a base and a lid, both of which are seamless and formed in a single piece.

Another objective of the present invention is to provide burial container of the type described wherein the inside and outside walls form hollow chambers that can be filled with cellular concrete or other structural flowable materials for strength and rigidity.

Another object of the present invention is to provide a burial container of the type described wherein the outside wall cover may be tied to the inside cover by spacers which become a part of the seamless structure during the molding process and wherein the lid is secured to the base by chemical and/or mechanical means.

A further object of the present invention is to provide a burial container wherein the lid and base are formed from synthetic resinous material.

Yet another object of the present invention is to provide a burial container which may be produced by simple rotational molding and filling techniques Which does not require a special heavy-duty mold and adhesive binding agent special climate controls, and precise manufacturing procedures combining various elements to form an ultimate defined structure.

Yet still another further object of the present invention to provide a new and improved seamless hollow-wall burial container, the lid and base units of which are light in weight, can be readily handled and transported economically over substantial distances, and can be filled at the grave site or centrally established locations with concrete or foam or at remote locations with structural flowable materials in a preselected density range for additional strength.

Still another object of the present invention is to provide a new and improved burial container of the type described, the components of which can be filled with a cellular concrete or other structural flowable materials fused sealed again to preserve the seamless integrity of the base and lid of the container.

These and other objects and advantages of the present invention will become more apparent after consideration of the following detailed description and accompanying drawings wherein like characters referenced designate like parts through the several views.

BRIEF DESCRIPTION OF THE DRAWINGS

The invention will be better understood and objects other than those set forth above will become apparent when consideration is given to the following detailed description. Such description makes reference to the annexed drawings where:

FIG. 16 is a planned, sectional, and fragmentary view of the insert construction of FIG. 15;

FIG. 26 is a side elevational, sectional view of the mold forming one embodiment of the present invention.

DESCRIPTION OF THE PREFERRED EMBODIMENT

Figure 1:
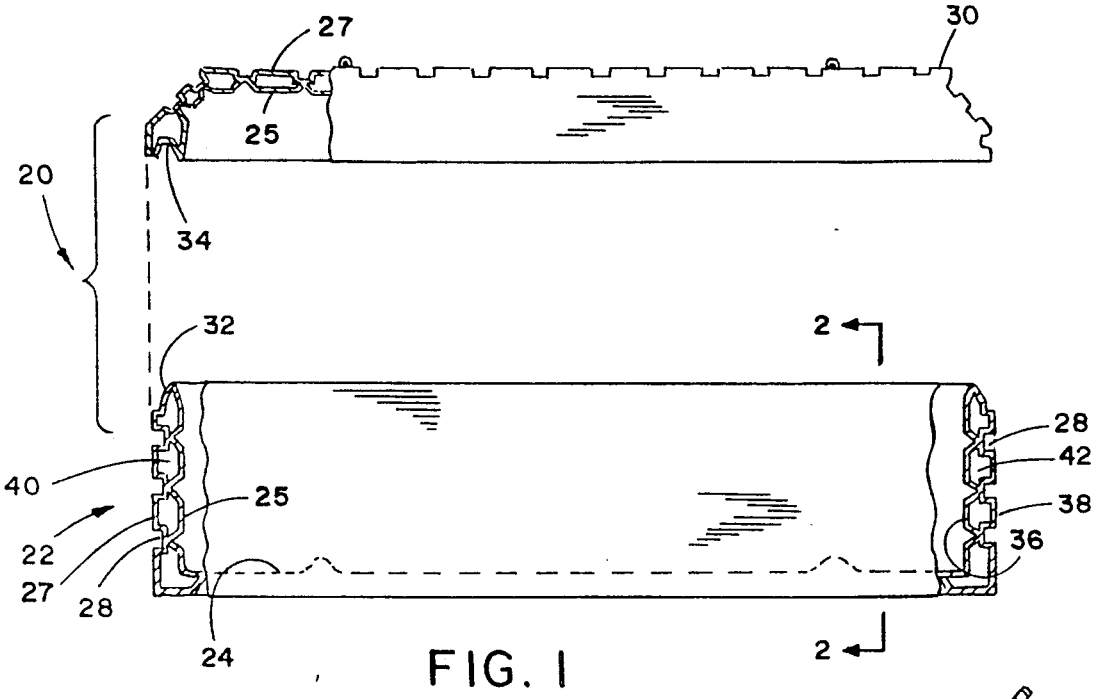
FIG. 1 is a side elevational, sectional, and exploded view of a burial container having a base and lid embodying the construction of the present inventive concept.
Figure 18:
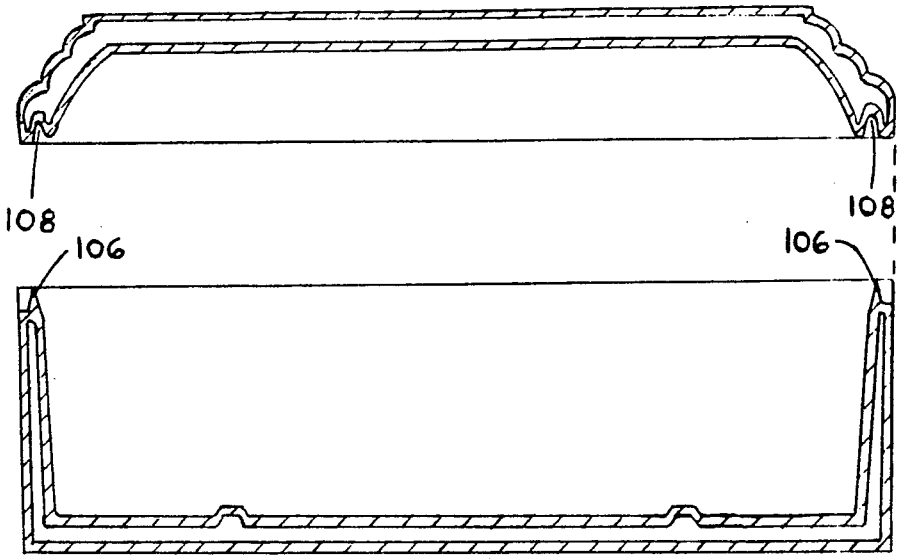
FIG. 18 is a side elevational, sectional and exploded view of the embodiment of the present invention utilizing parallel and unconnected inner and outer walls.
Figure 19:
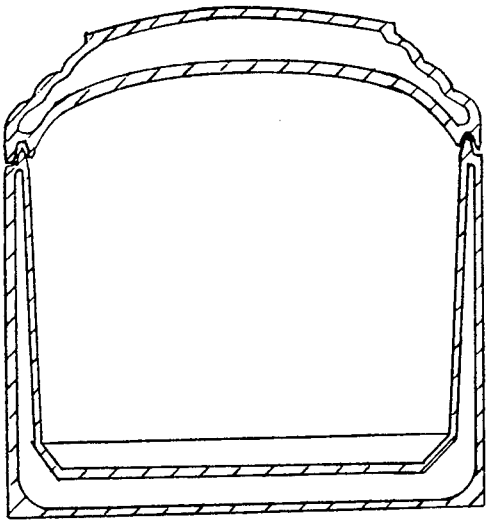
FIG. 19 is an end elevational, sectional view of the embodiment shown in FIG. 18.

Referring now to the drawings and particularly to FIG. 1, a burial container shown generally as 20 has a base generally shown as 22 which is provided with a bottom, side wall, end walls, a lid shown generally as 24, 26, 28, and 30, respectively. Bottom 24, side walls 26, end walls 28, and lid 30 all have an inner wall 25 and outer wall 27 and is sealably securable to base 22 by the interlocking action of a formed extension 32 cooperatively received within recess 34 of lid 30. Burial container 20 can be provided with a chemical sealant or other physically acceptable sealing alternatives at the junction of extension 32 and recess 34 well known in the art. Lid 30 and base 22 and its component bottom 24, side walls 26, and end walls 28, because of the chambers between inner wall 25 and outer 27, are capable of being filled with a number of substances including regular concrete, sand, cellular concrete, structural foam, granular mix and/or liquid solutions. Cellular concrete and structural foam are preferably utilized for reasons hereinafter stated. Inner and outer walls 25, 27 may be utilize in a parallel, unconnected manner as shown in FIGS. 18 and 19 or held in a fixed relationship each with the other at connecting junctions 40 by a number of alternative devices. These junctions: strengthen the walls, lid and bottom of the container to permit them to withstand the forces exerted by surrounding earth and water. That strength can be even more significantly increased by filling the hollow chambers formed by wall 25, 27 with substances such as cellular concrete or other structural flowable materials.

An essential feature of the present invention is the formation by the process of rotational molding of a seamless burial container heretofore not available with prior art devices. The base and lid components of the burial container comprising the present invention have continuously connected inner and walls that are seamless in construction and are tied together by inserts, their own edges 106, 108 or through special molding techniques that further maintain the walls in a firmer fixed relationship each with the other. The wall configuration provides hollow openings 110, 112 to receive strengthening and weight-bearing substances such as cellular concrete or other structural flowable materials. The inserts, spacers or joining units connecting the inner and outer walls can either be formed automatically from the molding process or supplied during the process so that a coating is applied over the units connecting the inner and outer walls that retains the seamless nature by totally covering the spacer and its intersection with the inner and outer walls. Thus a one-step operation can provide a totally seamless base and lid which are fillable with strength-giving and weight-providing substances and which can be formed from synthetic substances such as polyethylene and the like. Such materials are impervious to moisture, decay and otherwise crushing forces when provided with them strength-giving and load-bearing filler substances.

When the burial container embodiment shown in FIGS. 18 and 19 is utilized, cellular concrete or other weight-bearing substances may be uses with acceptable effectiveness. In the interest of efficient and cost-saving construction techniques parallel and unconnected walls may be filled with a structural foam which sets quickly for firm texture and enables the completion of a burial container embodying the present inventive concept in a heretofore unattainable short period of time. Moreover, the finished product is a burial vault that can weigh less than 200 pounds depending on the density of the material used as compared to the significant weights of 4 and 5 times that amount generally associated with prior devices. The foam sets with a firmness sufficient to maintain the walls in a strength providing alignment and a sealed condition, and the structural flowable material can be selected to give the device the weight desired or needed.

Figure 2:
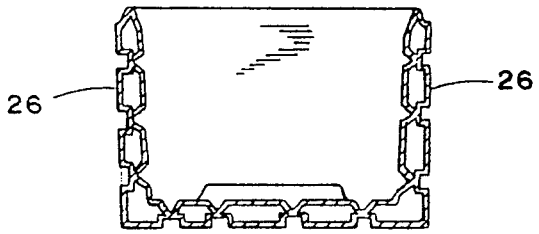
FIG. 2 is an end elevational and sectional view of the base of the burial container shown in FIG. 1.
Figure 3:
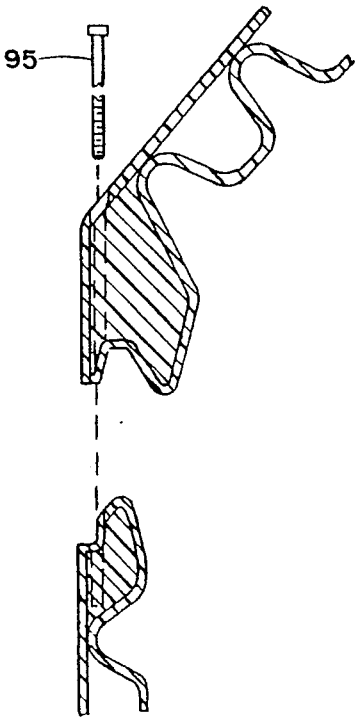
FIG. 3 is a sectional, enlarged, exploded, and fragmentary view of another form of construction embodying the present inventive concept and illustrating the use of bolts to fasten the lid to the base.
Figure 4:
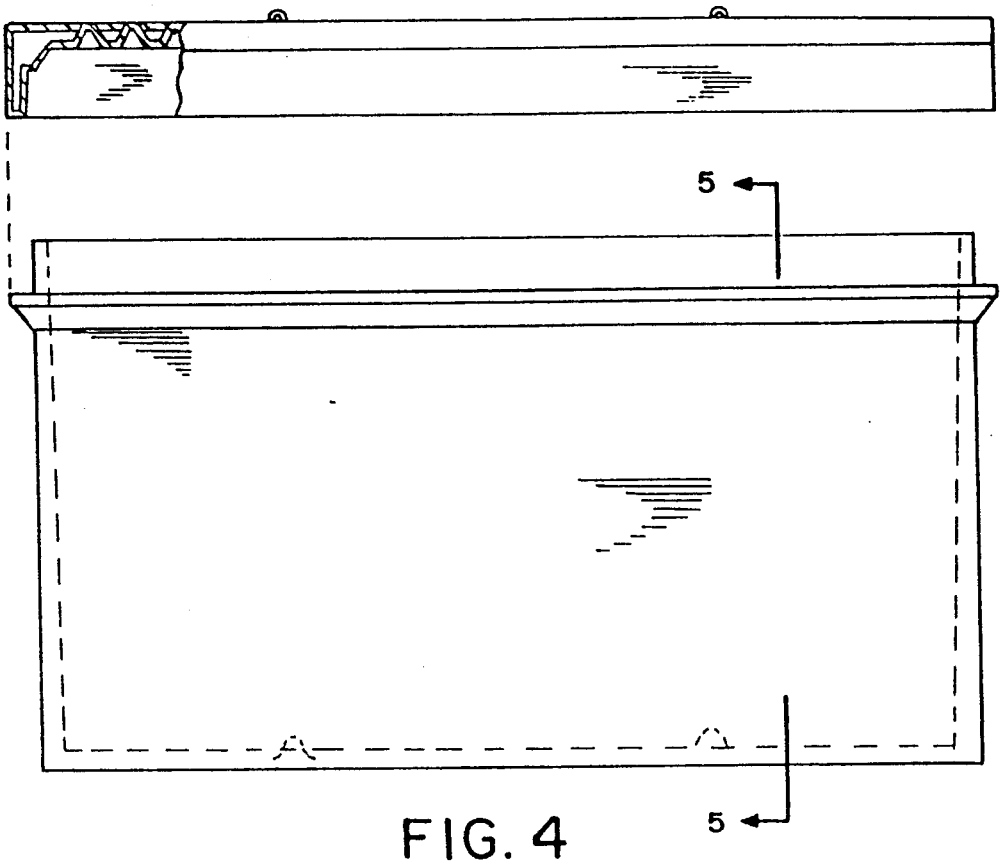
FIG. 4 is a side elevational, sectional, and exploded view of a double depth burial vault having a different wall-connecting construction.
Figure 5:
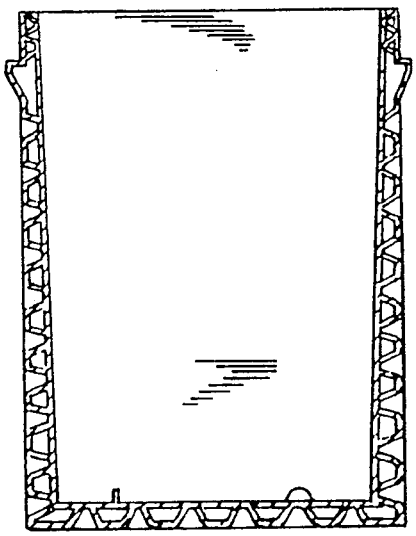
FIG. 5 is an end elevational and sectional view of the base of the burial container shown in FIG. 4.
Figure 20:
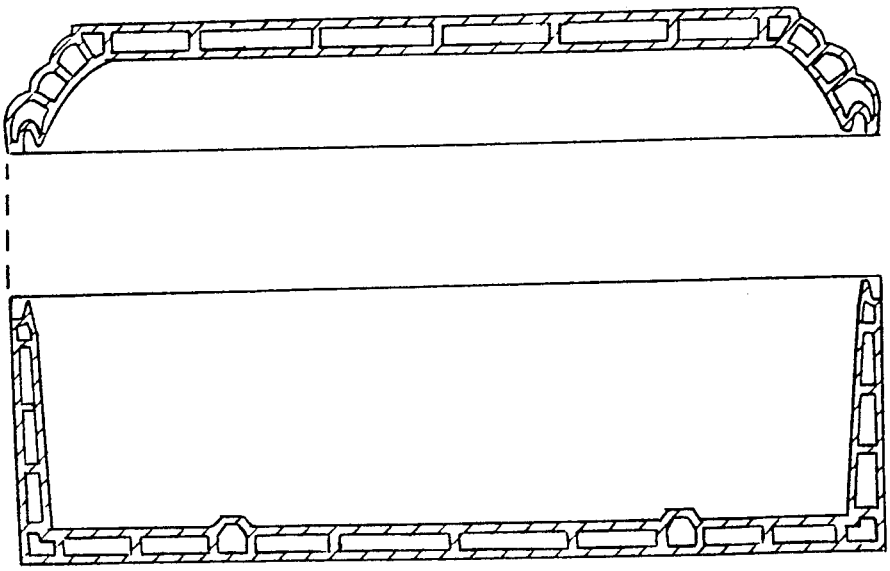
FIG. 20 is a side elevational sectional and exploded view of another embodiment of the burial vault comprising the present invention showing another arrangement for interconnecting the inner and outer walls of the base and lid.
Figure 21:
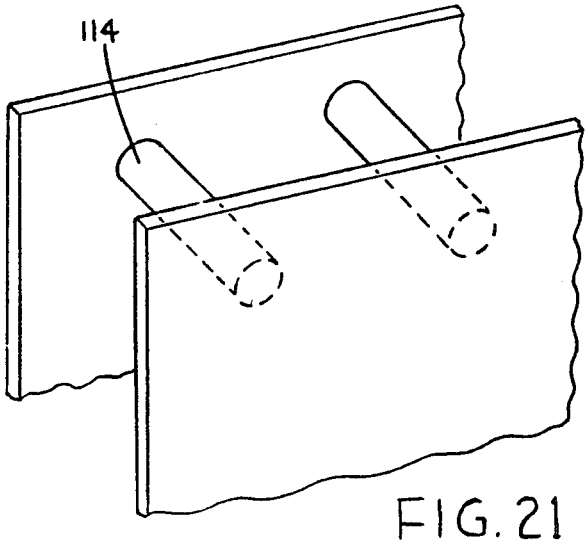
FIG. 21 is a side elevational, enlarged, fragmentary, and perspective view of fusible pins used to connect the inner and outer walls of the embodiment shown in FIG. 20.
Figure 22:
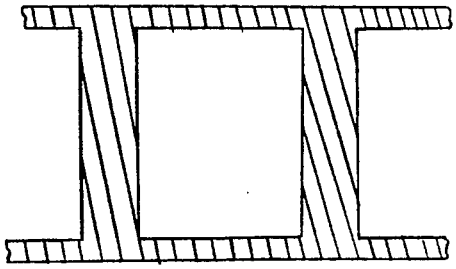
FIG. 22 is a plan, enlarged, sectional, and fragmentary view of the pin connected walls shown in FIG. 21.
Figure 23:
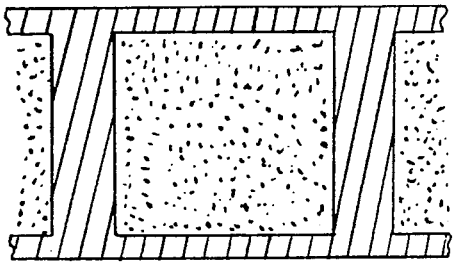
FIG. 23 is the plan view shown in FIG. 2 wherein the chambers within the inner connected walls are filled with cellular concrete or other structural flowable materials.
Figure 24:
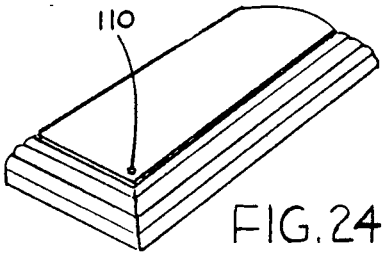
Figure 25:
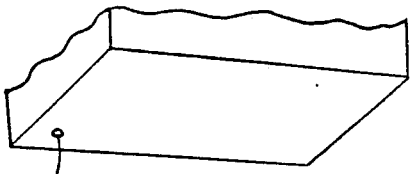
FIG. 25 is a perspective and fragmentary view of the base of one embodiment of the present invention showing the small opening through which is introduced the flowable material into the wall formed chambers of the vault.
Figure 26:
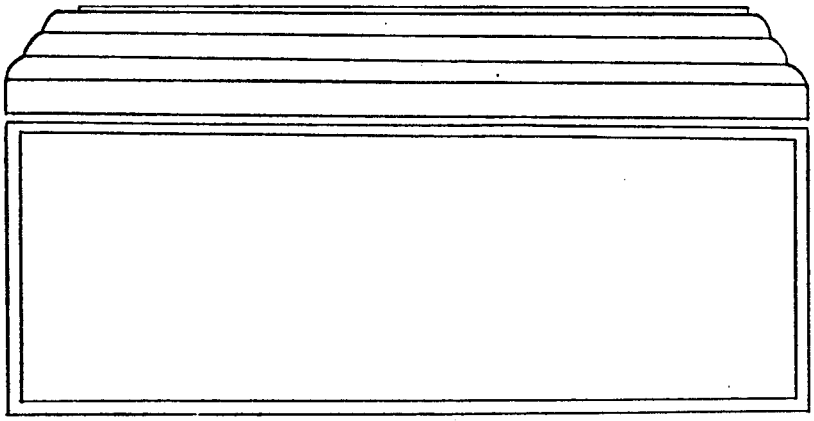
FIG. 26 is a perspective view of a lid of one embodiment of the present invention showing the small opening through which the flowable material is introduced into the chamber of the lid.

When a more rigid construction is desired, a configuration like that shown in FIG. 20 may be utilized wherein a plurality of pins 116 formed of a plastic material similar to the material used to create the walls of the base and lid but having a higher melting point can be positioned in the mold during the molding process thereby fusing with the formed walls. The result is a dual wall burial vault different in configuration from the embodiment shown in FIGS. 1, 2 and 3.

Figure 11:
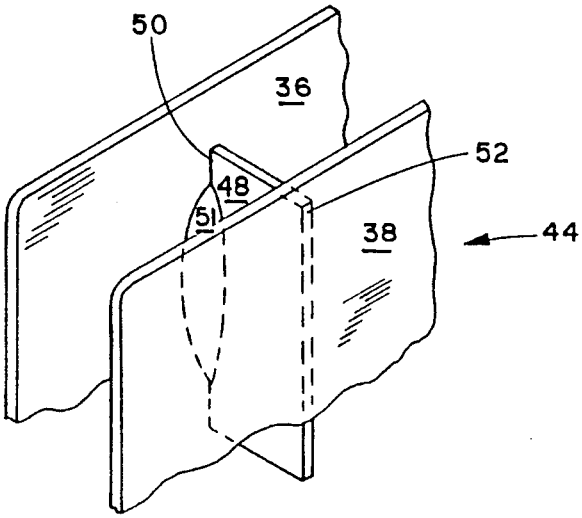
FIG. 11 is a perspective, enlarged, sectional, and fragmentary view of an embodiment of an insert or connecting unit used in the present inventive concept.
Figure 12:
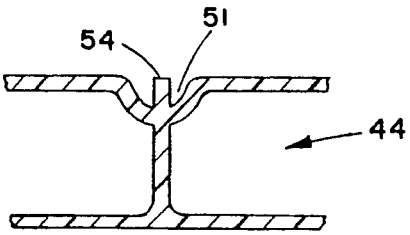
FIG. 12 is a planned and fragmentary view of the insert shown in FIG. 11.

The most straightforward junction formed when utilizing a spacer element is generally designated as 44 in FIGS. 11 and 12. A substantially flat section 48 has inner and outer cover edges 50, 52 which either prior to or during the molding process are fused to the inner and outer walls 36, 38. The more flat sections 48 that are applied, the greater the strength of the resulting burial container. Even greater strengths occur when one or perhaps both of the covers 36, 38 are provided with a recess 51 within which extends the flat section 48 so that a projection 54 is formed as shown in FIG. 12.

Figure 13:
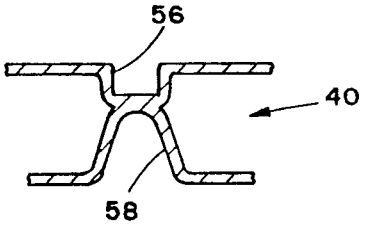
FIG. 13 is a planned, sectional, and fragmentary view of another embodiment of an insert utilizing the present inventive concept.
Figure 14:
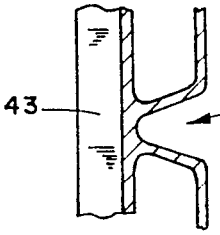

Junction construction takes many forms, all of which are designed to enhance the physical characteristics of the burial container, particularly by strengthening the cover and walls, bottom and lid. FIG. 13 shows the use of two connective junctions, the first 56 having a U-shaped configuration formed one wall and the second 58 being V-shaped in the other parallel wall. FIG. 14 shows a junction designated generally as 42 by a V-shaped insert bonded to a series of spaced apart ribs 43 fused to the outside of either the inner or outer wall.

Figure 15:
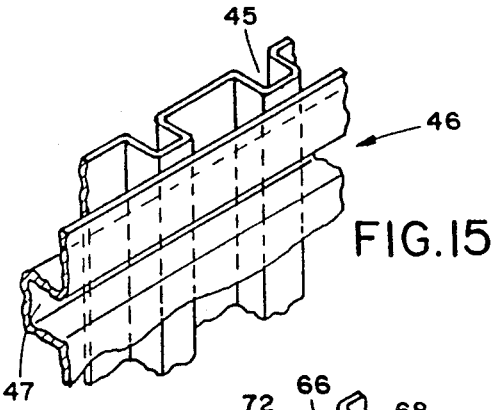
FIG. 15 is a perspective, sectional, and fragmentary view of another embodiment of insert construction utilized in the present inventive concept.
Figure 16:
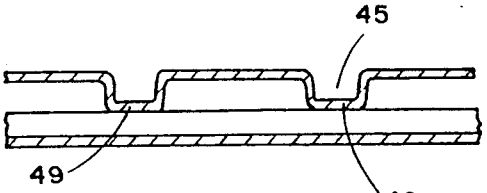
FIG. 16 is a planned, sectional, and fragmentary view of yet still another form of an insert embodying the present inventive concept.

FIGS. 15 and 16 illustrate yet another variation of a junction construction developed by forming vertical grooves 45 in one cover and horizontal grooves 47 in the other cover that are fused each with the other at the intersections 49 of the horizontal and vertical grooves. This will provide an extremely strong structure for the containers' lid, walls, and bottom and will eliminate. In many cases the need for any additional fill or structure reinforcement.

Figure 17:
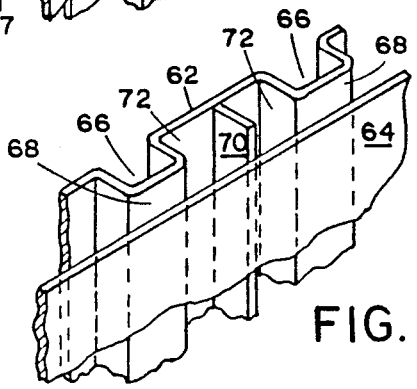
FIG. 17 is a perspective, sectional, and fragmentary view of yet another form of insert construction utilizing the present inventive concept.

Yet another variation of a quite acceptable junction structure is shown in FIG. 17 wherein inner cover 62 is connected to outer cover 66 by a series of formed grooves 66, the bottom 68 of which are bonded to the inner wall of cover 66. An additional flat section insert 70 is positioned between covers 62,64 and between groove 66 in the manner shown. This construction provides additional strength by the addition of flat section 70 and yet makes available a plurality of hollow chamber 72 that can be filled with additional granular, liquid or combination substances to improve rigidity and strength.

The various junctions shown in FIGS. 11–17 are formed through the rotational molding process wherein heat is used to melt and fuse a plastic resin in a closed mold. After the charged mold is moved into an oven, the mold is generally rotated on two (2) axes at low speed. As heat penetrates the mold, the resin adheres to the mold's inner surface until it is completely fused. The mold is then cooled by air or water spray or a combination of both while still rotating, thus lowering the temperature in a gradual manner. The mold is then opened, the finished part removed, and the mold recharged for the next cycle. The entire process is critically controlled so that the thickness of the pad surfaces can be varied in accordance with structural or architectural requirements.

A variety of materials are available for use in such a process. The most widely known are polyethylenes and plastisols, however other acceptable materials include nylon, fluoropolymers, polypropylene, polycarbonate, cellulose, acetate, butyrate, elastomers, and EVA.

The significant feature of the present invention is the production for the first time of a seamless hollow burial container base and lid. There have been no previous seamless hollow burial containers formed which can be shipped in unfilled form and filled with weight-giving substances upon or near the time or location of use.

Kiss-off ribbing is a unique capability of a rotational molding process. With this form of reinforcement, two (2) closely spaced walls are attached to each other to provide added strength and dimensional stability. It has been used effectively to counteract warpage in large, flat surfaces and to provide an added strength and baffling inside military fuel tanks.

In the present invention, the junctions shown in FIGS. 11–17 are in some instances formed by the provision of kiss-offs, although the shape of the mold can in effect provide the ribbing utilized in the embodiment shown in FIGS. 15, 16 and 17. In any event, the added structural strength to the burial container comprising the present invention is of great significance.

Figure 7:
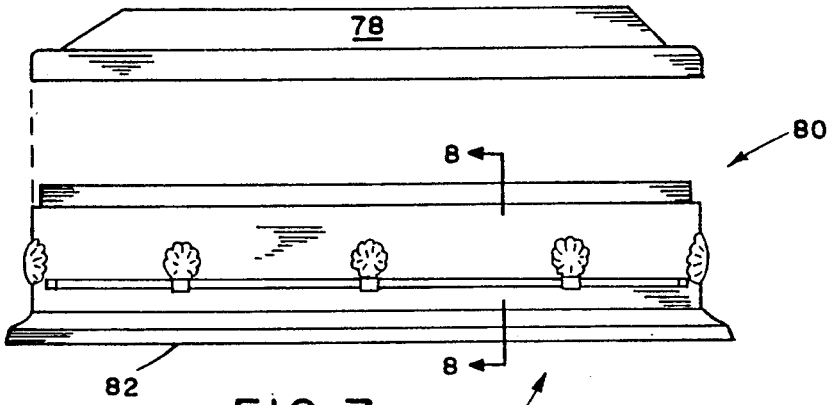
FIG. 7 is a side elevational and exploded view of another burial container construction utilizable with the present inventive concept.
Figure 8:
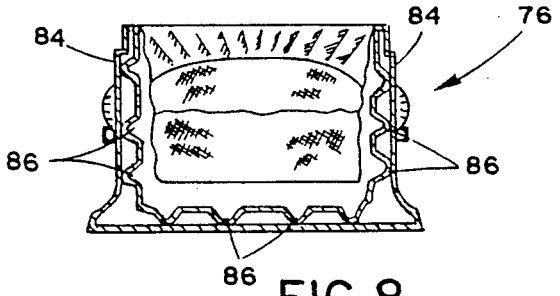
FIG. 8 is an end elevational and sectional view of the of the burial container shown in FIG. 7.

The container comprising the present invention can be utilized as a complete burial container in and of itself or as a vault to serve as an outer container for an insert casket. For example, FIGS. 7 and 8 illustrate the use of the structure of the present inventive concept and the formation of an aesthetically assembled casket generally shown in 76. Casket 76 has a sealable securable lid 78, a base 80 with a bottom 82, side walls 84 and end walls (not shown in detail). The lid, bottom, and sides all are formed from parallel wall is suitably maintained in a spaced relationship and of strength-giving configuration by a plurality of junctions 86 as shown in FIG. 8. Such a casket construction can be economically provided, aesthetically designed and decorated, and sealably closed to function in an effective manner, far more effectively than conventional vault and casket combinations.

Figure 6:
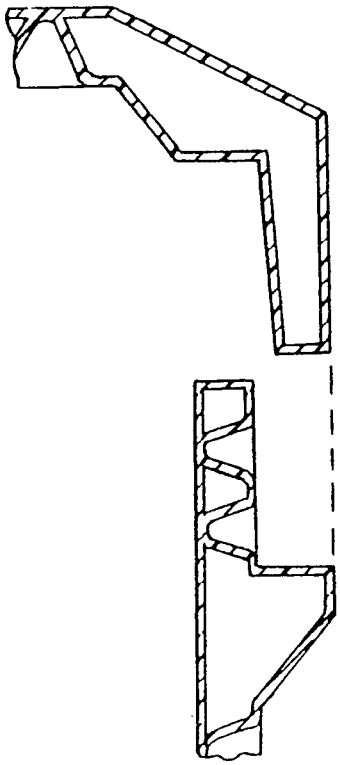
FIG. 6 is a sectional, enlarged, exploded, and fragmentary view of the connectable structure of the burial container construction shown in FIGS. 4 and 5.
Figure 9:
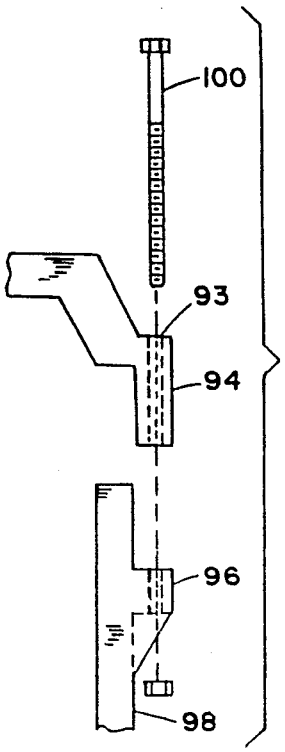
FIG. 9 is a sectional, enlarged, exploded, and fragmentary view of a lid-securing mechanism embodied in the construction the present invention.

Special sealing applications may be needed to ensure a totally waterproof container not susceptible to moisture seepage or other encroachments. FIG. 6 shown an overlapping lid lip 90 snugly engaging a side wall projection 92. A suitable adhesive or binder can be applied between the engaging surfaces of lip 90 and projection 92 to ensure a total seal. FIG. 9 shows a slight modification of this configuration by having a plurality of apertures extending through the lip 94 and ridge 96 of base 98 through which can then be positioned a securing bolt or other suitable element 100. Again, a sealant or other bonding substance can be applied to the contiguous edges of lid 94 and base 96. FIG. 9 shows the use of a plurality of bolts 95 to secure the lid to the base. When this version is used, the bolts 95 should be spaced about 12 inches apart.

Figure 10:
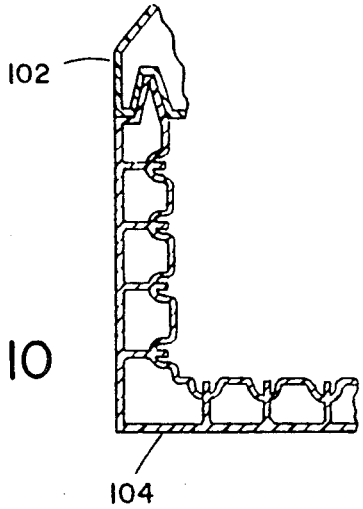
FIG. 10 is a side elevational, sectional, and fragmentary view of another internal configuration of a burial container embodying the present inventive concept.

FIG. 10 shows yet another variation in a complimentary mating of a lid 100 and a base 104 with the insert structure utilizing the configuration illustrated in FIG. 11 and FIG. 12.

In the event a bolt or other fastening element is used to secure the lid to the base in any of the present embodiments, it is preferable to have the areas surrounding the bolt or element formed of solid plastic or metal and not configure it with the junction structures described above. Solid resinous material plastic will provide a much stronger foundation for the fastening element.

Figure 27:
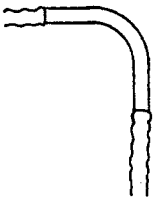
FIG. 27 is a plan, enlarged, sectional and fragmentary of one corner of the mold shown in FIG. 26.

Certain decorative features can be built into the mold forming the burial vault of the present invention so that various textured surfaces on the outside wall will be discernable when the burial vault is used. FIG. 27 shows the formation of side and end walls with a flat metal corner wherein the side and end walls are embossed with a particular design that will be reflected in the finished vault.

Thus it can be seen that the undesirable characteristics and disadvantages of prior art burial containers have been overcome in the present inventive concept. With respect to the description provided, it is to be realized that the optimum dimensional relationship for the parts of the invention, to include variations in size, materials, shape, form, function and manner operations, assembly and use, are deemed readily apparent and obvious to one skilled in the art, and all equivalent relationships to those illustrated in the drawings and described in the specification are intended to be encompassed herein.

The foregoing is therefore considered as illustrative only of the principles of the invention. Further, since numerous modifications and changes will readily occur to those skilled in the art, it is not desired to limit the invention to the exact construction and operations shown and described. All suitable modifications and equivalents that fall within the scope of the appended claims are deemed within the present inventive concept.

What is claimed is:

1. A burial container formed from a non-corrosive material comprising: a seamless single piece base having a bottom, sides and ends, each of which has an inner wall and an outer wall; a seamless single piece lid having an inner and outer wall sealable securable to the base; and means securing the lid to the base, the lid, bottom, side and end inner and outer walls forming hollow chambers capable of being filled with structural strength and weight-giving substances so that the base, lid, bottom, side and end inner and outer walls are held in a substantially fixed relationship with each other.

2. The container as claimed in claim 1 wherein the base and lid have sealable openings to receive non-adhering strength and weight-giving substances.

3. The container as claimed in claim 2 wherein one or more of the base, lid, bottom, side and end inner walls has a plurality of recesses fused to the corresponding base, lid, bottom, side and end outer wall.

4. The container as claimed in claim 2 wherein each base, lid, bottom, side and end inner wall has a plurality of recesses fused to the corresponding base, lid, bottom side and end outer wall.

5. The container as claimed in claim 2 wherein the base, lid, bottom, side and end inner and outer walls are connected by forming vertical grooves in one base, lid, bottom, side and end inner wall and horizontal grooves in the corresponding base, lid, bottom, side and end outer wall that are fused with each other at the intersections of the horizontal and vertical grooves.

6. The container as claimed in claim 2 wherein each base, lid, bottom, side and end inner and outer wall has a plurality of recesses, the inner wall recesses connecting with the corresponding outer wall recesses.

7. The container as claimed in claim 1 wherein one or more of the base, lid, bottom, side and end inner walls has a plurality of recesses fused to the corresponding base, lid, bottom, side and end outer wall.

8. The container as claimed in claim 1 wherein each base, lid, bottom, side and end inner walls has a plurality of recesses fused to the corresponding base, lid, bottom, side and end outer wall.

9. The container as claimed in claim 1 wherein the base, lid, bottom, side and end inner and outer walls are connected by forming vertical grooves in one base, lid, bottom, side and end outer wall and horizontal grooves in the corresponding base, lid, bottom side and end outer wall that are fused with each other at the intersections of the horizontal and vertical grooves.

10. The container as claimed in claim 1 wherein each base, lid, bottom, side and inner and outer wall has a plurality of recesses, the inner wall recesses connecting with the corresponding outer wall recesses.

* * * * *